United States Patent [19]

Lamb

[11] Patent Number: 5,058,532

[45] Date of Patent: Oct. 22, 1991

[54] DEVICE FOR OPERATING AN ANIMAL SQUEEZE CHUTE

[76] Inventor: George K. Lamb, Box 340, Gruver, Tex. 79040

[21] Appl. No.: 628,446

[22] Filed: Dec. 17, 1990

[51] Int. Cl.[5] ..... A61D 3/00

[52] U.S. Cl. ..... 119/98; 119/99

[58] Field of Search ..... 119/98, 99, 103, 147.1; 49/108, 110

[56] References Cited

U.S. PATENT DOCUMENTS

| | | | |
|---|---|---|---|
| 3,084,669 | 4/1963 | May | 119/98 |
| 3,623,456 | 11/1971 | Priefert | 119/99 X |
| 3,720,187 | 3/1973 | McDonough | 119/98 |
| 4,059,073 | 11/1977 | Roark | 119/98 |
| 4,116,166 | 9/1978 | Gofflot | 119/99 |

*Primary Examiner*—Gene Mancene
*Assistant Examiner*—R. Thomas Price
*Attorney, Agent, or Firm*—Norman B. Rainer

[57] ABSTRACT

A device for closing a pivotable wall of an animal squeeze chute utilizes a high torque electric motor that rotates a ratchet arm less than a half revolution about a drive shaft. An action arm pivotably associated with the ratchet arm engages the pivotable wall. When the motor is activated, the ratchet arm is quickly rotated to an extreme position where it is locked in place, and the pivotable wall is simultaneously forced to its closed position by the action arm. When the motor is deactivated and the ratchet arm unlocked, a counterweight restores the pivotable wall to its starting, open position.

4 Claims, 3 Drawing Sheets

DEVICE FOR OPERATING AN ANIMAL SQUEEZE CHUTE

BACKGROUND OF THE INVENTION

1. Field of the Invention

This invention concerns a chute for the temporary restraint of farm animals, and more particularly concerns a device for causing a pivotable wall of a chute to releasibly squeeze and thereby restrain an animal within the chute.

2. Description of the Prior Art

Animal restraining chutes are used to maintain a farm or herd animal in a reasonably immobile condition during an inspection, treatment or tagging operation. The animals may be of large size and are generally in an excited state, thereby presenting considerable risk to those workers who operate the chute. One type of chute, generally known as a squeeze chute, is comprised of two vertical side walls, at least one of which can be horizontally swung inwardly to cause the animal to be squeezed between the two walls. Most such chutes are manually operated with a lever that is pulled downward to close the side wall, and releases upwardly to open the chute, namely release the pressure on the animal. Such closing of the sidewall requires considerable force, and can be achieved only by strong workers. There is usually a ratchet and latch that holds the side wall in its closed position. However, such levers frequently become accidentally unlatched, causing injury to attending personnel.

Mechanically operated chutes are known, particularly those which employ hydraulic piston means to open and close the pivoted wall. However, such devices are of complex, expensive construction requiring considerable maintenance, and cannot be operated in outlying regions having no source of electrical power. The hydraulic devices also produce considerable noise, which makes cattle nervous and harder to handle, and are slow-acting.

It is accordingly an object of the present invention to provide a chute closing device that is easy and safe to use.

It is another object of this invention to provide a device as in the foregoing object having few moving parts, requiring little maintenance, and amenable to low cost manufacture.

It is a further object of the present invention to provide a device of the aforesaid nature which is fast acting, and can be powered by storage batteries or electrical current produced by an automotive vehicle.

These objects and other objects and advantages of the invention will be apparent from the following description.

SUMMARY OF THE INVENTION

The above and other beneficial objects and advantages are accomplished in accordance with the present invention by a device adapted for use with an animal squeeze chute having fixed and pivotable vertical walls in facing juxtaposition, said device serving to rapidly and controllably swing said pivotable wall between open and closed positions, and comprised of:

a) a high-torque electric motor having an output shaft equipped with a toothed gear drive wheel, b) a flywheel having a toothed circular rim that engages said drive wheel, said flywheel being orthogonally centered upon drive shaft means having forward and rearward extremities, c) a housing that accommodates said flywheel and has apertured front and rear panels equipped with bushings which rotatively support the forward and rearward extremities respectively, of said drive shaft means, d) a ratchet arm having upper and lower extremities and orthogonally mounted upon the rearward extremity of said drive shaft means exterior to said housing, said upper extremity having a series of unidirectionally oriented teeth, said ratchet arm being adapted to rotate less than a half revolution about said drive shaft means from a starting position to a stop position when activated by the motor, e) an elongated action arm having a proximal extremity pivotably joined to the lower extremity of said ratchet arm, and a distal extremity adapted to engage said pivotable wall, said action arm being adapted to move substantially horizontally and thereby swing said wall to its closed position when said ratchet arm is in its stop position, and allow said wall to go to its open position when said ratchet arm is in its starting position, f) a latching arm pivotably mounted upon the rear panel of said housing and having a forward extremity that engages said teeth and thereby retains the ratchet arm in its stop position, and a rearward extremity which is spring-biased in a manner to urge said forward extremity toward said teeth, g) release means for pressing against the rearward extremity of said latching arm in opposition to said spring-biasing to cause the latching arm to disengage said teeth, and h) counterbalance weight means which, when said teeth are disengaged, cause said ratchet arm to be restored to its starting position, with attendant movement of said pivotable wall to its open position.

In preferred embodiments, the motor is an automotive starting motor capable of activation by 12 volt direct current.

A clutch assembly may be disposed between the flywheel and ratchet arm to provide adjustability of the closing force exerted upon the pivotable wall.

The device is preferably disposed above the squeeze chute, and the elongated action arm is adapted to engage the top edge of the pivotable wall.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
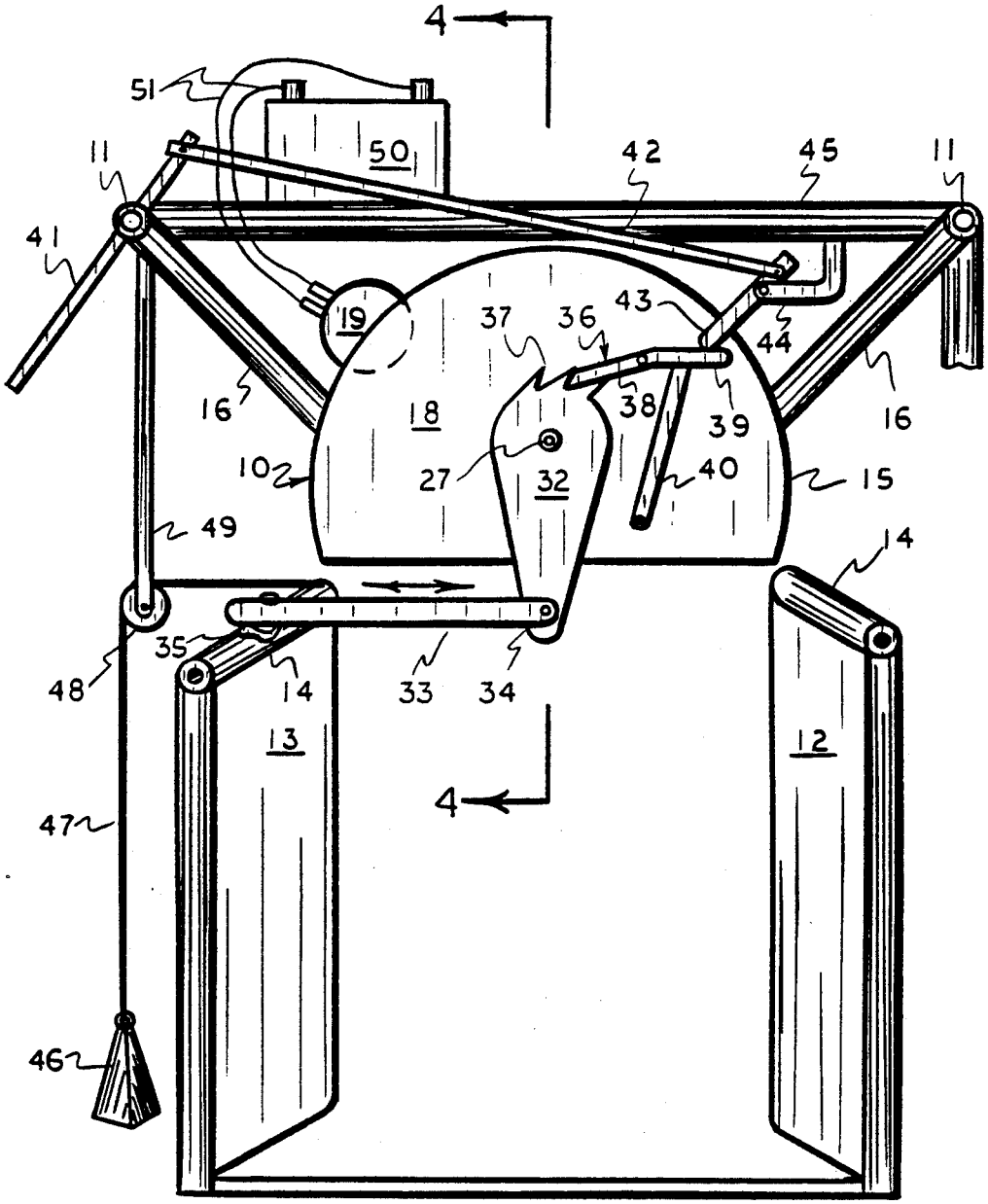
FIG. 1 is a rear view of an embodiment of the device of the present invention shown in operative association with a cattle chute.
Figure 2:
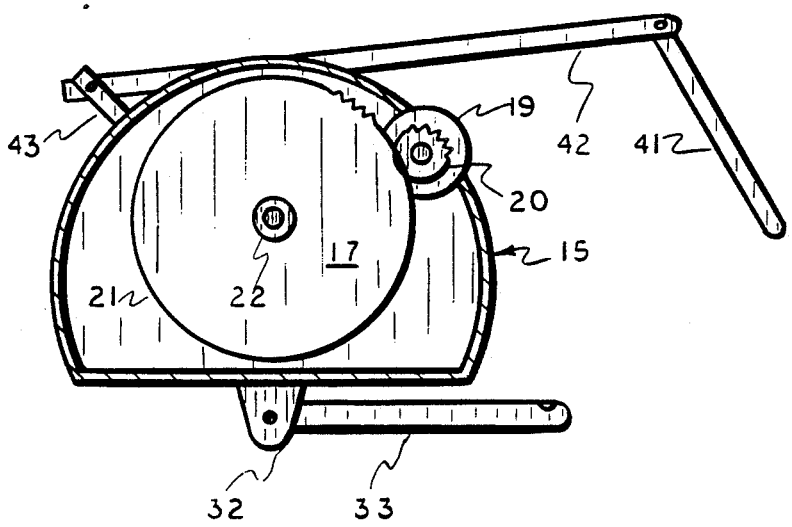
FIG. 2 is a fragmentary front view of the embodiment of FIG. 1.
Figure 3:
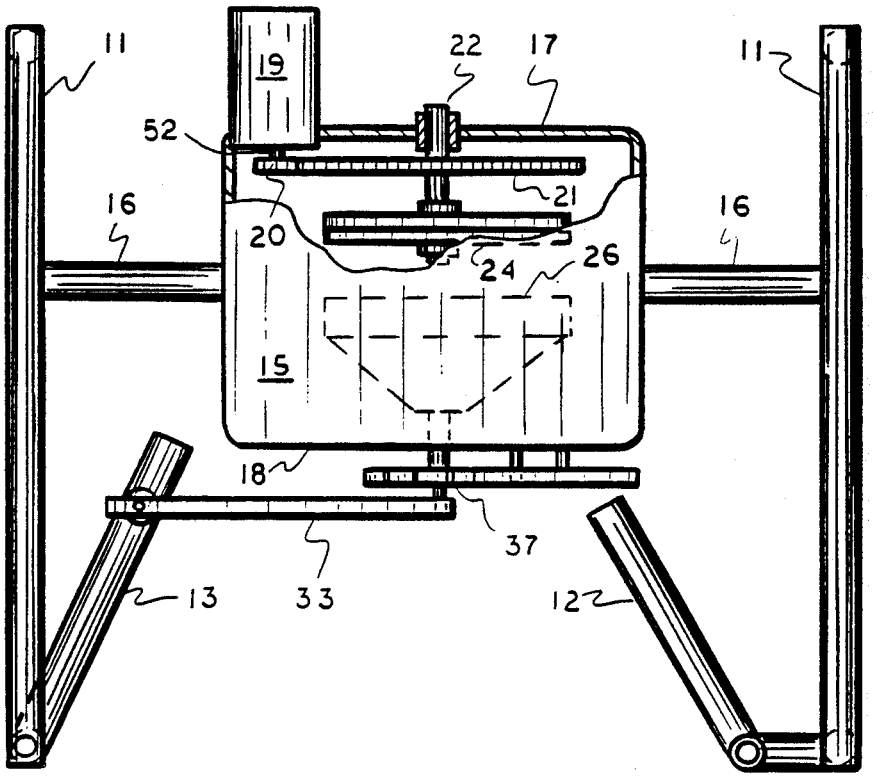
FIG. 3 is a top view, with portions removed to show underlying and interior details.

Referring to FIGS. 1–4, an embodiment of the chute operating device 10 of the present invention is shown mounted upon the top frame rails 11 of a cattle chute having stationary vertical wall 12 and pivotable vertical wall 13, said walls having upper edges 14.

The device is comprised of a housing 15 suspended by angled struts 16 attached to top frame rails 11, said housing having apertured front and rear panels, 17 and 18, respectively.

A high-torque electric motor 19, associated with front panel 17, has an output shaft 52 extending into said housing and equipped with toothed gear drive wheel 20. The motor is preferably a standard automotive type starter motor capable of operation on 12 volt D.C. current.

A flywheel 21, orthogonally centered upon drive shaft 22 journaled to front panel 17, has a toothed circular perimeter 23 that engages drive wheel 20. The ratio of teeth on said drive wheel and flywheel, and the rotational speed of the motor are such that said drive shaft may be turned at between about 50 and 100 rpm. Expressed alternatively, the time duration required to turn the drive shaft 60 degrees of a single revolution is between about 0.1 and 0.2 second.

Figure 4:
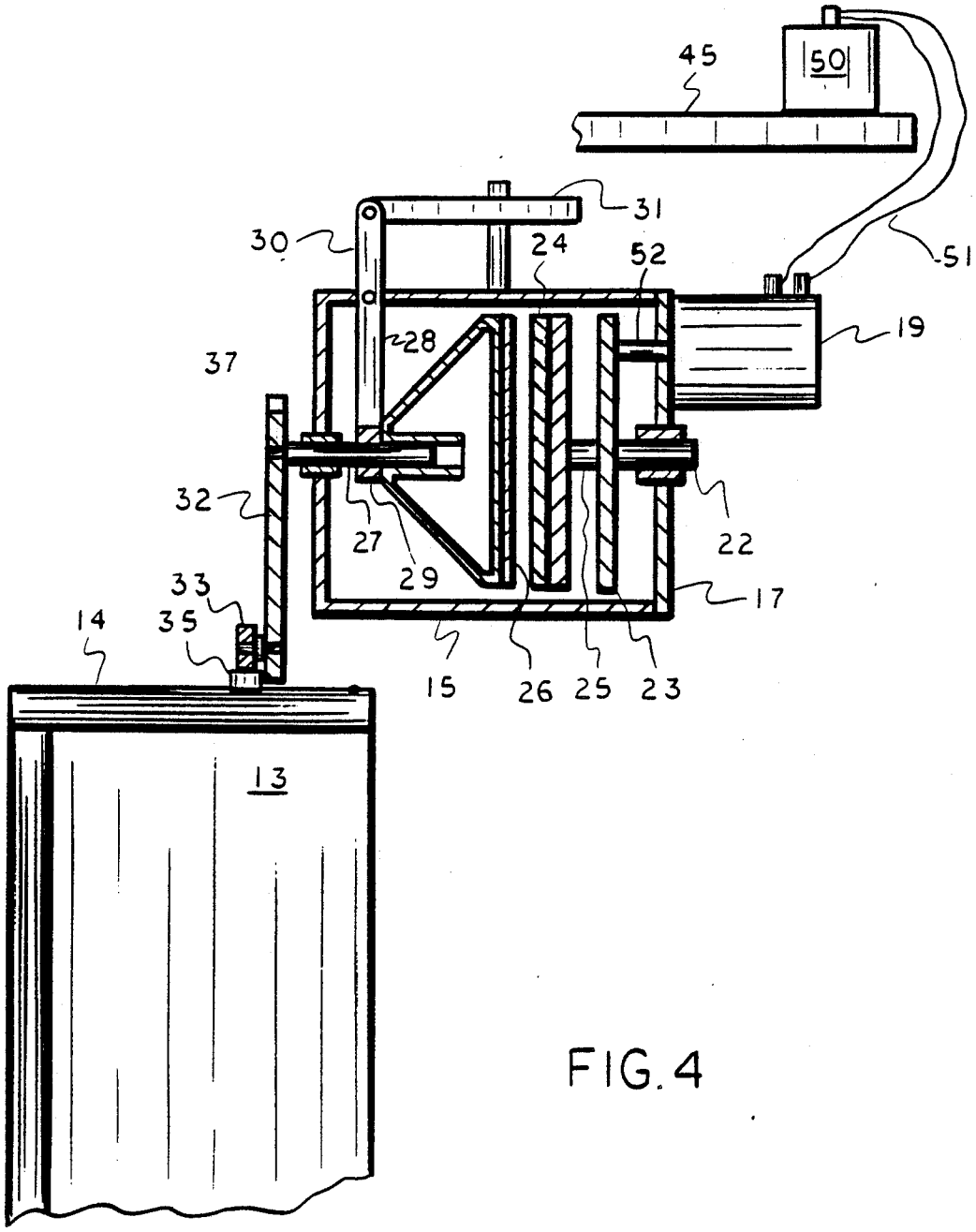
FIG. 4 is a sectional side view taken upon the line 4-4 of FIG. 1.

As shown most clearly in FIG. 4, the illustrated embodiment contains within said housing an automotive clutch assembly comprised of friction disc member 24 centered upon coupling 25 adapted to engage drive shaft 22, and traveling pressure plate 26 centered upon splined shaft 27 journaled to rear panel 18. Clutch arm 28 has a bifurcated distal extremity 29 that adjusts the position of pressure plate 26, and a proximal extremity 30 extending outside said housing to pivotal engagement with threadably adjustable control rod 31. Adjustment of control rod 31 modifies the amount of force transmitted between motor 19 and splined shaft 27. It is to be noted however, that splined shaft 27 is essentially an extension of drive shaft 22. In the absence of the clutch assembly, said shafts would be integral, and are accordingly referred to collectively for the purpose of this invention as drive shaft means.

A ratchet arm 32 is orthogonally affixed to that portion of splined shaft 27 that extends beyond rear panel 18 of said housing. The upper extremity of arm 32 is provided with a series of unidirectionally oriented teeth 37 disposed in a circular arc of about 60 degrees extent. The ratchet arm, when activated by motor 19, is adapted to be rotated by splined shaft 27 about 60 degrees of one revolution to a stop position.

An elongated action arm 33 has a proximal extremity 34 that is pivotably joined to the lower extremity of said ratchet arm below splined shaft 27, and a distal extremity 35 which pivotably engages the upper edge 14 of pivotable wall 13. Action arm 33 is disposed substantially horizontally, and positioned above the upper edges 14 of the walls of the chute. As shown by the double arrow in FIG. 1, wall 13 is moved to the closed state of the chute when action arm 33 moves to the right. Such action occurs when motor 19 is activated.

A latching arm 36, pivotably mounted upon rear panel 18, has a forward extremity 38 that engages teeth 37, and a rearward extremity 39 which is upwardly urged by compression coil spring 40 anchored to rear panel 18. By virtue of such arrangement, the latching arm will prevent reverse rotation of ratchet arm 32, thereby maintaining wall 13 in its closed state.

A release assembly is provided comprised of handle arm 41 pivotably associated with a top rail 11, and transverse arm 42 pivotably interconnected between arm 41 and control arm 43. Control arm 43 is pivotably supported by post 44 downwardly emergent from platform 45 which extends between top rails 11. Said release assembly functions in a manner whereby the pushing of handle arm 41 to the right causes control arm 43 to press downwardly against rearward extremity 39 of latching arm 36. Such action overcomes the force of spring 40 and releases forward extremity 38 from engagement with teeth 37.

Counterbalance weight 46 is suspended by tether 47 that attaches to wall 13 and passes around pulley wheel 48 secured by pendant arm 49 held by frame rail 11. Said counterbalance weight causes the ratchet arm to be restored to the open position of the chute when latching arm 36 is released.

A 12 volt battery 50 rests upon platform 45. Conductors 51 electrically connect the battery with motor 19. A conventional on-off electrical switch, not shown, is conveniently mounted preferably adjacent handle arm 41, to permit activation of the motor.

By virtue of the aforesaid components and their mode of interaction, the chute is rapidly and safely closed upon an animal by motor 19, and the chute is opened by handle 41 to release the animal.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device adapted for use with an animal squeeze chute having fixed and pivotable vertical walls in facing juxtaposition, said device serving to rapidly and controllably swing said pivotable wall between open and closed positions, and comprising of:

a) a high-torque electric motor having an output shaft equipped with a toothed gear drive wheel, b) a flywheel having a toothed circular rim that engages said drive wheel, said flywheel being orthogonally centered upon drive shaft means having forward and rearward extremities, c) a housing that accommodates said flywheel and has apertured front and rear panels equipped with bushings which rotatively support the forward and rearward extremities respectively, of said drive shaft means, d) a ratchet arm having upper and lower extremities and orthogonally mounted upon the rearward extremity of said drive shaft means exterior to said housing, said upper extremity having a series of unidirectionally oriented teeth, said ratchet arm being adapted to rotate less than a half revolution about said drive shaft means from a starting position to a stop position when activated by the motor, e) an elongated action arm having a proximal extremity pivotably joined to the lower extremity of said ratchet arm, and a distal extremity adapted to engage said pivotable wall, said action arm being adapted to move substantially horizontally and thereby swing said wall to its closed position when said ratchet arm is in its stop position, and allow said wall to go to its open position when said ratchet arm is in its starting position, f) a latching arm pivotably mounted upon the rear panel of said housing and having a forward extremity that engages said teeth and thereby retains the ratchet arm in its stop position, and a rearward extremity which is spring-biased in a manner to urge said forward extremity toward said teeth, g) release means for pressing against the rearward extremity of said latching arm in opposition to said spring-biasing to cause the latching arm to disengage said teeth, and h) counterbalance weight means which, when said teeth are disengaged, cause said ratchet arm to be restored to its starting position, with attendant movement of said pivotable wall to its open position.

2. The device of claim 1 wherein said motor is an automotive starting motor capable of activation by 12 volt direct current.

3. The device of claim 1 wherein a clutch assembly is disposed between the flywheel and ratchet arm in association with said drive shaft means, said clutch assembly functioning to provide adjustability of the force exerted upon said pivotable wall.

4. The device of claim 1 disposed above said squeeze chute and disposing said action arm to engage said pivotable wall at an upper extremity thereof.

* * * * *